United States Patent [19]

Blindow et al.

[11] 4,260,194

[45] Apr. 7, 1981

[54] METHOD AND DEVICE FOR PRODUCING UNDERGROUND CAVITIES USING A DRIVING SHIELD

[75] Inventors: Friedrich-Karl Blindow, Innsbruck, Austria; Jürgen Decker, Oberaudorf, Fed. Rep. of Germany; Heinrich Kluibenschedl, Rietz, Austria; German Munding, Bad Friedrichshall; Armin Sowa, Ottobrunn, both of Fed. Rep. of Germany; Harald Wagner, Innsbruck, Austria

[73] Assignee: Messerschmitt-Bölkow-Blohm GmbH, Fed. Rep. of Germany

[21] Appl. No.: 956,787

[22] Filed: Nov. 1, 1978

[51] Int. Cl.[3] ..... E21C 27/24

[52] U.S. Cl. ..... 299/11; 175/15; 299/14; 299/33; 299/60

[58] Field of Search ..... 299/11, 14, 31, 33, 299/58, 17; 175/15

[56] References Cited

U.S. PATENT DOCUMENTS

| | | | |
|---|---|---|---|
| 2,018,926 | 10/1935 | Schroepfer | 299/17 |
| 2,426,688 | 9/1947 | Higgs | 299/14 |
| 3,245,721 | 4/1966 | Margiloff | 299/14 |
| 3,325,217 | 6/1967 | Enz | 299/31 |
| 3,596,995 | 8/1971 | Fitzegerald | 299/11 |
| 3,603,100 | 9/1971 | Cowley | 299/11 |
| 3,791,697 | 2/1974 | Hokao | 299/14 |
| 4,043,137 | 8/1977 | Jutte | 299/31 |
| 4,077,670 | 3/1978 | Spies et al. | 299/11 |

*Primary Examiner*—William F. Pate, III

*Attorney, Agent, or Firm*—McGlew and Tuttle

[57] ABSTRACT

A method of producing an underground cavity in a driving shield advance operation comprises, prior to excavation, forming an annular slot corresponding to the contour and wall thickness of the shield ahead of the shield by using hot gas jets to form the slot and to separate a core from the surrounding rock formation, advancing the shield into the annular slot, and breaking out the core under the protection of the shield. The device for producing the underground cavity comprises a tubular drive shield adapted to be advanced into the cavity and having an interior support wall on which is rotatably supported a support member having an arm carrying a gas jet lance. The gas jet lance advantageously includes at least one gas nozzle directed forwardly to form an inwardly extending cavity ahead of the shield, and one or more nozzle discharges directing the gas laterally. The jet nozzle is rotated after it is advanced into the ground, and the gas jets form an annular slot ahead of the shield which accommodates the shield therein. The shield is then moved into the slot by the usual shield advance cylinders. Walls behind the shield are braced by a lining wall which, for example, may be thin walled rings which may be positioned in place.

5 Claims, 3 Drawing Figures

METHOD AND DEVICE FOR PRODUCING UNDERGROUND CAVITIES USING A DRIVING SHIELD

BACKGROUND OF THE INVENTION

1. Field of the Invention

The invention relates in general to mining devices and methods and in particular to a new and useful method of and apparatus for producing underground cavities in a driving operation using a shield advance.

2. Description of the Prior Art

To produce underground cavities, for example, in the construction of tunnels, adits, or caverns, the conventional shield tunneling method provides that a shield is mechanically advanced into the ground. In this operation, considerable frictional forces are produced between the shield and the ground which are absorbed, through hydraulic pressure devices, by the following lining. The inner core is then mechanically excavated under the protection of the shield. What is disadvantageous in this method is that the shield advance causes a compression of the surrounding ground in the zone, frequently resulting in a heave of the formation ahead of the work, which becomes manifest during the further advance in a loosening of the rock structure, and this may lead to damaging subsidences. Also, the surrounding formation is thereby considerably disturbed. Another disadvantage is that the lining, mostly tubbings, must withstand the high pressures occurring during the intermediate stage of construction, so that usually it is to be oversized with respect to its final function. In consequence, notwithstanding its advantages in driving operations with mechanical excavation and lining, the conventional shield tunneling method cannot meet the requirements of the New Austrian Tunneling Method, in which the natural supporting strength of the formation is to be maintained to a large extent by preserving the grown structure of the rock, and the cavity is secured by a thin-walled lining. Moreover, the application of the conventional shield tunneling method is limited to loose rock formations.

SUMMARY OF THE INVENTION

The invention is directed to a method which makes it possible to apply the shield tunneling method both to hard and loose rocks. A further objected is to improve the known method of shield tunneling so as to fully comply with the requirements of the New Austrian Tunneling Method. The purpose of the inventive method is to maintain the mechanical operation of driving with the usual shield advance, but to surpass the prior art in its economic and technological effect.

To this end and in accordance with the invention, a method of producing underground cavities by driving with a shield advance is provided in which an annular slot extending circumferentially along the designed contour of the cavity and corresponding to the wall thickness of the shield is hollowed out at the front side of the shield, ahead of the working face by means of a hot gas jet technique, then the shield is advanced into the annular slot, and the rock core separated from the surrounding formation by the annular slot is excavated under the protection of the shield.

With the inventive shield tunneling method, an annular slot true to shape is produced along the designed contour of the cavity by employing a hot gas jet technique, known per se, but in a way preserving the grown rock structure, into which the shield is advanced while applying only a small power and avoiding a compression and later loosening of the surrounding rock. The natural supporting strength of the rock therefore remains unaffected and at the same time, due to the obtainable high accuracy in shape of the annular slot, a costly profile in excess ordinarily to be taken into account in conventional tunneling methods is avoided. Depending on the nature of the rock and because of the fusion on the outer boundary of the annular slot, the rock surface structure is improved with the effect of a primary securement of the cavity roof, so that a further support with a lining may even be omitted. After or during the shield advance, the inner rock core is removed mechanically or, preferably, also by applying a fluid jet technique, under the protection of the shield, and, if necessary, the respective portion of the cavity at the rear of the shield, is secured by a lining, for example, of thin-walled, segmentally assembled prefabricated tubbings and/or gun-deposited concrete.

The inventive shield tunneling method can substantially be applied to any driven tunneling or caverning work and meets the requirements of the New Austrian Tunneling Method while using mechanical mining equipment.

The shield machine for carrying out the method comprises a combustion chamber and one or more hot gas nozzles or lances connected thereto which each produce a high-velocity hot gas jet to form an annular slot corresponding in shape to the contour of the shield. For this purpose, a plurality of hot gas boreholes may be made at spaced-apart, adjacent, or intersecting locations according to the geometry of the annular slot. Preferably, a hot gas jet lance is provided having at least one discharge nozzle on its front end and a plurality of sidewards directed discharge nozzles distributed over the length of the lance to produce the annular slot. The lance is first moved forward in the shield advance direction, so that the front nozzle of the lance produces a borehole having a depth corresponding to that of the provided annular slot. The lance is moved from this position in the transverse direction, along a path following the contour of the shield and the designed cross-sectional outline of the cavity, so that starting from the initially produced borehole, the annular slot is cut into the heading continuously and in its full depth. During the transverse motion of the hot gas jet lance, the no longer needed front discharge nozzle may be switched off. The slot may be produced with a stepwise operation or continuously in a helical motion. The shield or individual shield segments which are arranged circumferentially in sequence, are advanced into the completed slot.

Accordingly, it is an object of the invention to provide an improved method of producing underground cavities in a driving shield advance operation which comprises, prior to excavation, forming an annular slot corresponding to the contour and wall thickness of the shield at the front side of the shield by using hot gas jets to form the slot, and to separate a core from the surrounding rock formation inwardly of the slot, and further including advancing the shield into the slot which is formed and breaking the core out under to protection of the shield.

A further object of the invention is to provide a device for producing underground cavities which comprises a tubular drive shield adapted to be advanced into a cavity and having an interior support wall for supporting a support member which is rotatably and axially movable on the support wall and has a radially extending arm portion which carries a gas jet lance having nozzle discharge means directed ahead and transversely, which are supplied with hot gases, and which further includes means for rotating the support member with the nozzle means so as to direct the gases therefrom to form an annular slot in the ground ahead of said shield to a size accommodated to take the shield.

A further object of the invention is to provide a device for producing underground cavities which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
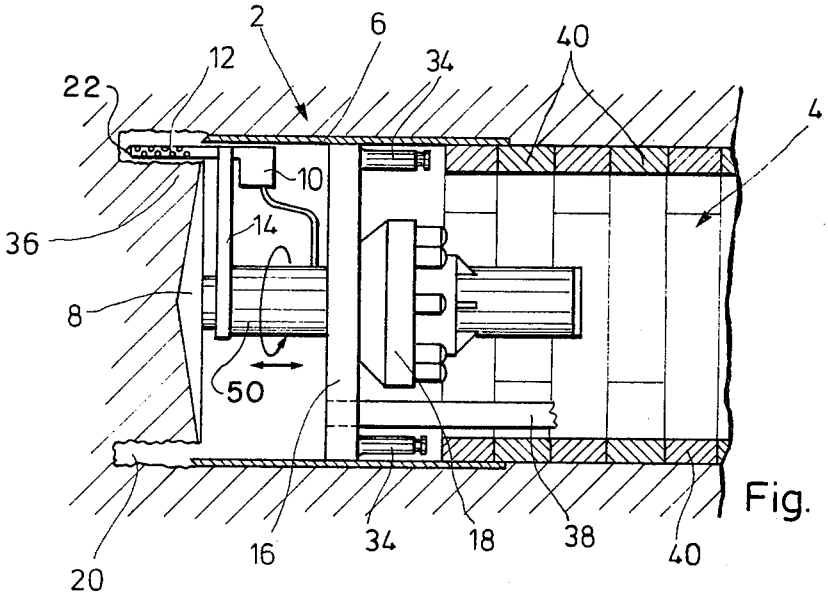
FIG. 1 is a schematic sectional view of a shield machine constructed in accordance with the invention shown in position in an underground cavity which is being formed.

Referring to the drawings in particular, the invention embodied therein comprises a device for producing underground cavities which comprises a shield machine generally designated 2.

The shield machine 2 shown in FIG. 1 serves the purpose of driving an underground cavity in the form of a tunnel 4 and comprises as substantial parts a shield 6, a central cutter head 8, and a combustion chamber 10 associated with a hot gas jet lance 12 which is connected to the combustion chamber and guided for rotary motion relative to shield 6 and for reciprocating motion in the advance direction by means of a control arm 14. Both cutting head 8 and control arm 14 are driven by a central drive unit 18 which is secured to the shield support 16 and which is effective to rotate, or move axially, a central shield member 50 connected to the arm 14.

Figure 2:
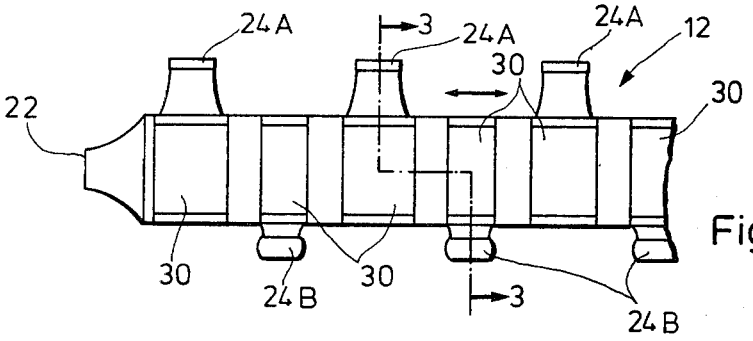
FIG. 2 is an enlarged elevational view of a gas jet lance for the shield machine shown in FIG. 1.
Figure 3:
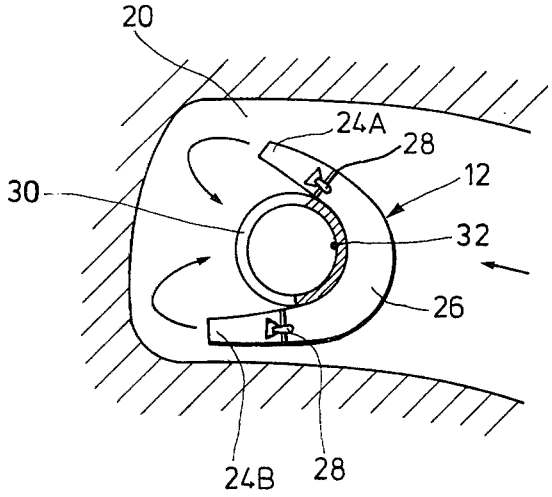
FIG. 3 is a diagrammatical sectional view taken along the line 3—3 of FIG. 2.

Prior to the excavating operation proper of shield machine 2, an annular slot 20 is cut into the heading by means of hot gas jet lance 12 shown in detail in FIGS. 2 and 3, which slot corresponds to the counter of shield 6. On its front end, lance 12 is equipped with a discharge nozzle 22 pointing in the longitudinal direction of the lance, and on its lateral surface, to lance carries a plurality of sidewardly directed discharge nozzles 24A, B. Hot reaction gases produced in combustion chamber 10 are supplied to the individual slot-shaped nozzles 22, 24 through a distribution channel 26 shown in FIG. 3. The gases are discharged as hot gas jets at a high velocity through the respective nozzles. To afterburn the reaction gases, a fuel injection head 28 is provided in each discharge nozzle 22 and 24. Since the lateral discharge nozzles 24 A, B extend obliquely, the annular slot 20 is produced having a radial width which is larger than the radial width of jet lance 12, to at least the wall thickness of shield 6. The waste gases from discharge nozzles 22 and 24 and the borings obtained during the hollowing out of annular slot 20 are evacuated through a central collecting tube 32 having a plurality of radial apertures 30 facing in the discharge direction of nozzles 24.

With combustion chamber 10 in operation, lance 12 is first advanced by control arm 14 along shield 6 to a selected location, during which advance at least discharge nozzle 22 is open until the lance has penetrated into the heading to a depth corresponding to that of the provided annular slot 20. Then, discharge nozzles 24 are opened and control arm 14 is moved in a rotary motion and reciprocated in oscillatory motion in the advance direction, so that lance 12 is guided transversely to the advance direction along a path corresponding to the contour of the provided annular slot 20 and along shield 6. In this way, annular slot 20 is cut into the heading in a manner preserving the structure of the rock. Upon termination of the flame jet cutting operation, advance cylinders 34 are actuated to advance shield 6 into annular slot 20 stepwise, or its segments sequentially, through a distance corresponding to the depth of annular space 20. During or after this motion, the inner core 36 now separated from the surrounding rock formation by annular slot 20 is broken out without affecting the surrounding rock, by means of cutting head 8 and under the protection of shield 6. Instead of the shown mechanical cutting head 8, another, non-mechanical cutting equipment may be used, for example, a hot gas drilling outfit which also is supplied with hot reaction gases from combustion chamber 10.

In view of the development of waste gases, heat, noise, and dust, shield machine 2 is compartmented by the shield support wall 16 and the borings and waste gases, which may be pre-cleaned in filters (not shown), are evacuated from the working area through one or more conveying tubes 38.

If necessary, the produced cavity is secured with a lining immediately following the shield machine 2. In the shown example, the lining is made of prefabricated, thin-walled tubbing rings 40 and/or of gun-deposited concrete. Only small forces are needed for advancing shield machine 2, so that rings 40 against which the advance cylinders 34 bear during the advance steps are loaded but slightly.

While specific embodiments of the invention have been shown and described in detail to illustrate the application of the principles of the invention, it will be understood that the invention may be embodied otherwise without departing from such principles.

What is claimed is:

1. A device for producing underground cavities, comprising a tubular drive shield adapted to be advanced into the cavity and having an interior support wall, a support member rotatably and axially movable supported on said support wall and having a radially extending arm portion, a gas jet lance supported on said arm portion, nozzle means associated with said gas jet lance directed ahead and transversely of said lance and said shield, means for supplying hot gases to said nozzle means, and means for rotating said support member and for shifting said support axially with said nozzle means to direct the gases therefrom to form an annular slot in the ground ahead of said shield of a size to accommodate said shield. said nozzle means including a nozzle directed axially of said lance at at least one nozzle directed at an angle to the axis of said lance.

2. A device according to claim 1 wherein there are a plurality of nozzles directed laterally of said lance.

3. A device according to claim 1 including means mounting said shield for axial displaceable movement into said slot in a liner disposed behind said shield.

4. A device for producing underground cavities, comprising a tubular drive shield adapted to be advanced into the cavity and having an interior support wall, a support member rotatably and axially movable supported on said support wall and having a radially extending arm portion, a gas jet lance supported on said arm portion, nozzle means associated with said gas jet lance directed ahead and transversely of said lance and said shield, means for supplying hot gases to said nozzle means, and means for rotating said support member and for shifting said support axially with said nozzle means to direct the gases therefrom to form an annular slot in the ground ahead of said shield of a size to accommodate said shield, said nozzle means including at least one discharge nozzle discharging axially ahead of said lance, at least one nozzle discharging radially of said lance, operating independently of said axial nozzle.

5. A device for producing underground cavities, comprising a tubular drive shield adapted to be advanced into the cavity and having an interior support wall, a support member rotatably and axially movable supported on said support wall and having a radially extending arm portion, a gas jet lance supported on said arm portion, nozzle means associated with said gas jet lance directed ahead and transversely of said lance and said shield, means for supplying hot gases to said nozzle means, and means for rotating said support member and for shifting said support axially with said nozzle means to direct the gases therefrom to form an annular slot in the ground ahead of said shield of a size to accommodate said shield, said hot gas jet or lance comprising a central collecting tube having an opening in the vicinity of said nozzle means, said nozzle means comprising an axially dischargeable nozzle and a plurality of laterally dischargeable nozzles, said opening providing means for the evacuation of waste gases and borings during formation of the slot.

* * * * *